United States Patent [19]

Schmidt et al.

[11] 4,407,177

[45] Oct. 4, 1983

[54] ON-LINE CORNER ROUNDER

[75] Inventors: Alfred J. Schmidt, Aston, Pa.; Michael H. Shearon, Cecil County, Md.

[73] Assignee: E. I. Du Pont de Nemours and Company, Wilmington, Del.

[21] Appl. No.: 381,216

[22] Filed: May 24, 1982

Related U.S. Application Data

[63] Continuation-in-part of Ser. No. 159,794, Jun. 16, 1980, abandoned.

[51] Int. Cl.[3] ..... B26F 1/12

[52] U.S. Cl. ..... 83/300; 83/337; 83/374; 83/395; 83/406; 83/670

[58] Field of Search ..... 83/98, 99, 152, 300, 83/337, 338, 406, 374, 395, 670, 917

[56] References Cited

U.S. PATENT DOCUMENTS

| | | | |
|---|---|---|---|
| Re. 13,486 | 11/1912 | Laukhuff | 83/337 |
| 1,067,626 | 7/1913 | Smith | 83/337 |
| 2,330,235 | 9/1943 | Peters | 83/337 |
| 3,242,785 | 3/1966 | Schieven et al. | 83/301 |
| 3,354,768 | 11/1967 | Liick | 83/345 |
| 3,411,390 | 11/1968 | Maynard et al. | 83/100 |
| 3,724,307 | 4/1973 | Johnson | 83/337 |
| 3,877,333 | 4/1975 | Illingworth et al. | 83/17 |
| 3,916,744 | 11/1975 | West | 83/337 |
| 4,080,856 | 3/1978 | Shearon | 83/99 |
| 4,202,230 | 5/1980 | Obinata | 83/345 |

*Primary Examiner*—James M. Meister

[57] ABSTRACT

An apparatus for cutting round corners on advancing sheets. The sheets are cut from a web and advanced continuously to a transport roll provided with aligned corner-rounding assemblies located to meet the line of cut between successive sheets.

9 Claims, 13 Drawing Figures

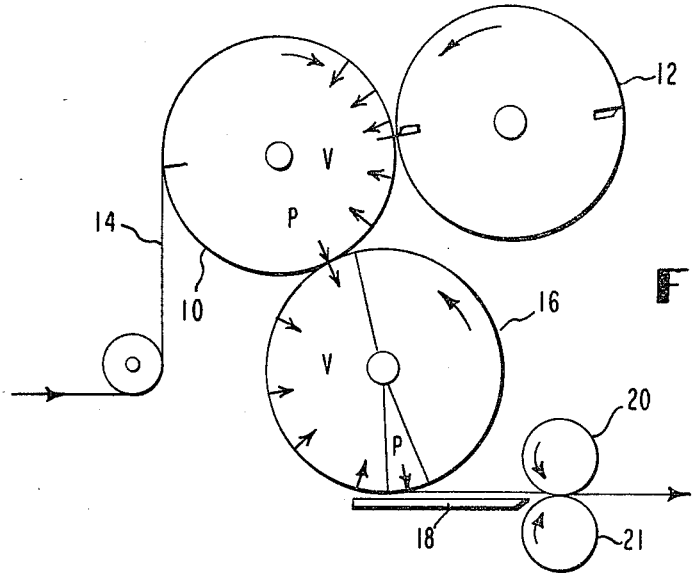
FIG. 1
FIG. 3
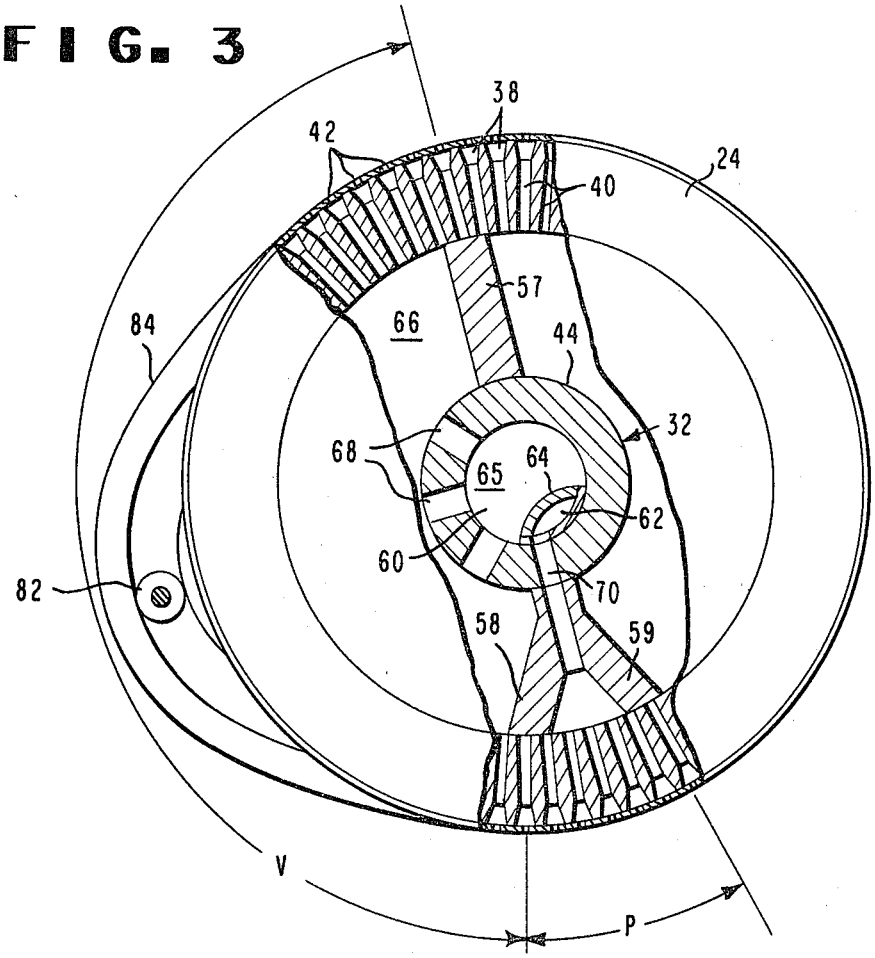

ON-LINE CORNER ROUNDER

CROSS-REFERENCE

This is a continuation-in-part of our copending application Ser. No. 159,794, filed June 16, 1989, now abandoned.

BACKGROUND

This invention relates to the production of sheet materials and, more particularly, to the provision of rounded corners on sheets cut from a web.

It is known and generally accepted that sheet materials such as X-ray films and punch cards should have rounded corners. It is also known that such corners can be provided by notching the sides of a running web and then cutting the web at the center of the notches. The difficulty with this mode of corner-rounding is that of lining up the cutters with the notches. Any failure to center the cut precisely on the notch leaves sharp strips of material on one of the sheets and an incomplete corner on the other. Another known mode involves stopping the process while the sheet just cut from the web is positioned and its corners rounded. Obviously, this presents a serious limitation on productivity. Still another mode involves cutting sheets from a web, stacking a predetermined number of the sheets and then moving the stack to off-line equipment which has cutters for corner-rounding the stacked plurality of sheets. In addition to costs of handling and equipment, difficulties have been encountered due to misalignment of individual sheets in their stacks.

SUMMARY OF INVENTION

The above and other disadvantages have been overcome with an apparatus that includes a transport roll having a peripheral surface located to receive successive sheets directly from a web-cutting roll. On the transport roll, there is at least a pair of spaced, cam-actuated, corner-rounding assemblies, one at each side of the path of transport. The assemblies are aligned longitudinally of the transport roll and located to meet the line of cut between successive sheets. Each assembly includes a die affixed to the transport roll and a punch mounted for reciprocation radially with respect to the die. The die is located beneath the level of the surface of the transport roll and the punch is reciprocable from a normal position in the die outwardly to a position beyond the surface of the transport roll. Corners are cut from successive sheets as the punch moves back to its normal position.

DESCRIPTION OF DRAWINGS

FIG. 1 is a schematic illustration of the apparatus of the invention and its association with a web cutter;

FIG. 3 is a sectional view taken on line 3—3 in FIG. 2;

DESCRIPTION OF APPARATUS

Figure 2:
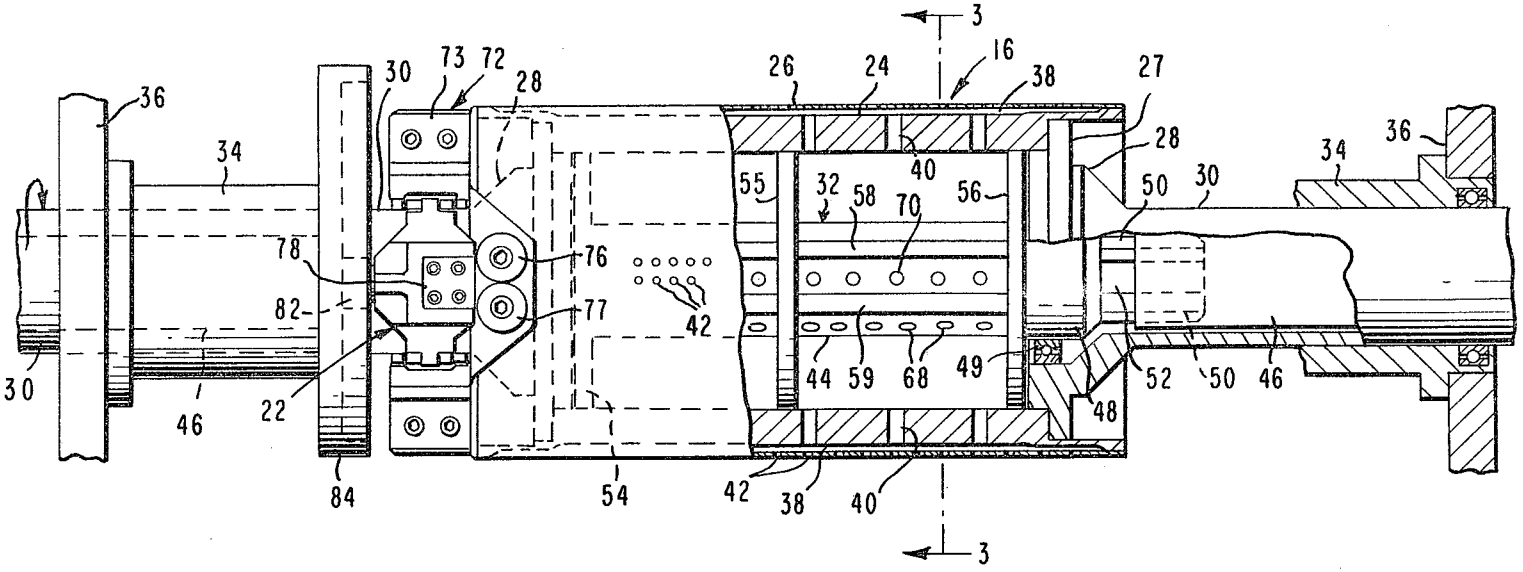
FIG. 2 is a bottom view of the apparatus, parts having been broken away and shown in section to reveal details of construction.

In FIG. 1, the apparatus has been shown in association with a web cutter of the type disclosed by Shearon in U.S. Pat. No. 4,080,856, the description and illustrations of which are incorporated herein by reference. Such a cutter includes synchronously driven rolls 10, 12, each carrying a pair of diametrically opposed blades. Roll 10 has a vacuum feature V for retaining a web 14 as it is cut by a pair of coacting blades and a pressure feature P for repelling a cut sheet as it approaches a transport roll 16 which carries the corner-rounding assemblies of the present invention. Roll 16 has a vacuum zone V where successive, abutting, cut sheets are retained as their corners are rounded. The leading sheet is then repelled from a pressure zone P to a platform 18 from which it is advanced to a stacking device by rolls 20, 21.

One of the corner-rounding assemblies has been shown at 22 in FIG. 2. There is, of course, a radially aligned assembly 22 at the other end of roll 16. Roll 16 includes a tubular rotor 24 covered by a perforated shell 26. Core 24 is attached to flanges 27 on end pieces 28 of shafts 30 which, in turn, are rotatable on a stator 32 and with respect to housings 34. The latter are attached to a supporting frame 36.

As shown in FIGS. 2 and 3, rotor 24 is provided with longitudinal channels 38 and drilled holes 40. Shell 26 has rows of perforations 42, each row being aligned with a channel 38.

Stator 32 has a tubular mid-section 44 and tubular end sections 46. Section 44 has an enlarged segment 48 within each end piece 28. The latter are rotatably mounted on bearings 49. Section 44 terminates at each end in fingers 50 which extend into and are secured to end sections 46. The latter do not cover the lengths of fingers 50, leaving open slots 52 through section 44. Within mid-section 44, there are partitions 54, 55, 56 and three longitudinal baffles 57, 58, 59. These stationary partitions and baffles extend into close proximity to rotor 24. The hollow interior of mid-section 44 is divided into two chambers 60, 62, by a flattened tube 64 that is connected at its ends (FIG. 4A) to a source of air under pressure. At its mid-point, tube 64 is interrupted by a plug 65 (FIG. 3) which also divides chamber 60. Chamber 60 communicates with a space 66 between baffles 57, 58 through holes 68. Chamber 62 in tube 64 communicates with a space between baffles 58, 59 through holes 70. Each end of chamber 60 is connected to a source of vacuum. The space 66 between baffles 57, 58 defines the zone V (FIG. 1) and the space between baffles 58, 59 defines the zone P.

Referring next to FIGS. 2 and 4–7, there is a die ring 72 secured to the end piece 28 on each shaft 30. Each die ring 72 has mating sections 73, 74 and the latter have through holes 75 (FIG. 7) for fasteners with which they are affixed to flanges 27 of end pieces 28. Each die ring carries a corner-rounding assembly 22 and each assembly includes a die and a punch. In the illustrated embodiment, the working edges of the die are on a pair of circular die inserts 76, 77 affixed by screws 94 in seats 95, 96 (FIG. 6) on the die ring beneath the level of shell 26. Thus, the die inserts are fixed to and rotatable with transport roll 16. The shell is cut away in this area to expose the die. Each corner-rounding assembly 22 also includes a punch 78 fastened to a shuttle 80 which slides in bearings mounted in the die ring, the direction of motion being radial to transport roll 16. A follower 82 projects from the side of shuttle 80 and rides in the track of a stationary cam 84.

The profile of cam 84 is shown in FIG. 3. When followers 82 at each end of the apparatus pass through the high points of their cam tracks, two shuttles 80 are driven radially outward and then back to the normal position. This occurs just before the middle of vacuum zone V (FIGS. 1 and 3). The corner-rounding assemblies at each end of the transport roll 16 are diametrically opposed. Thus, the circumference of shell 26 is twice the length of a cut sheet.

Figure 4:
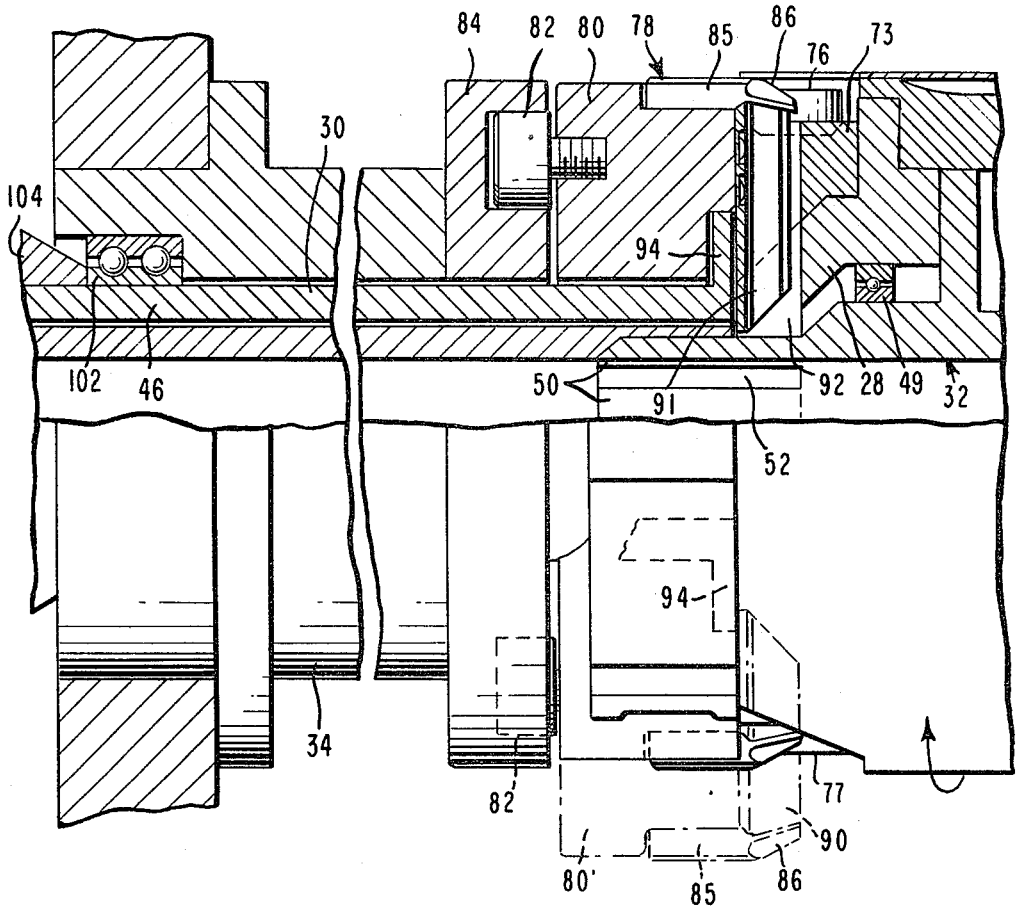
FIG. 4 is a fragmentary front view of the apparatus, parts having been broken away and shown in section to reveal details of construction.
Figure 4A:
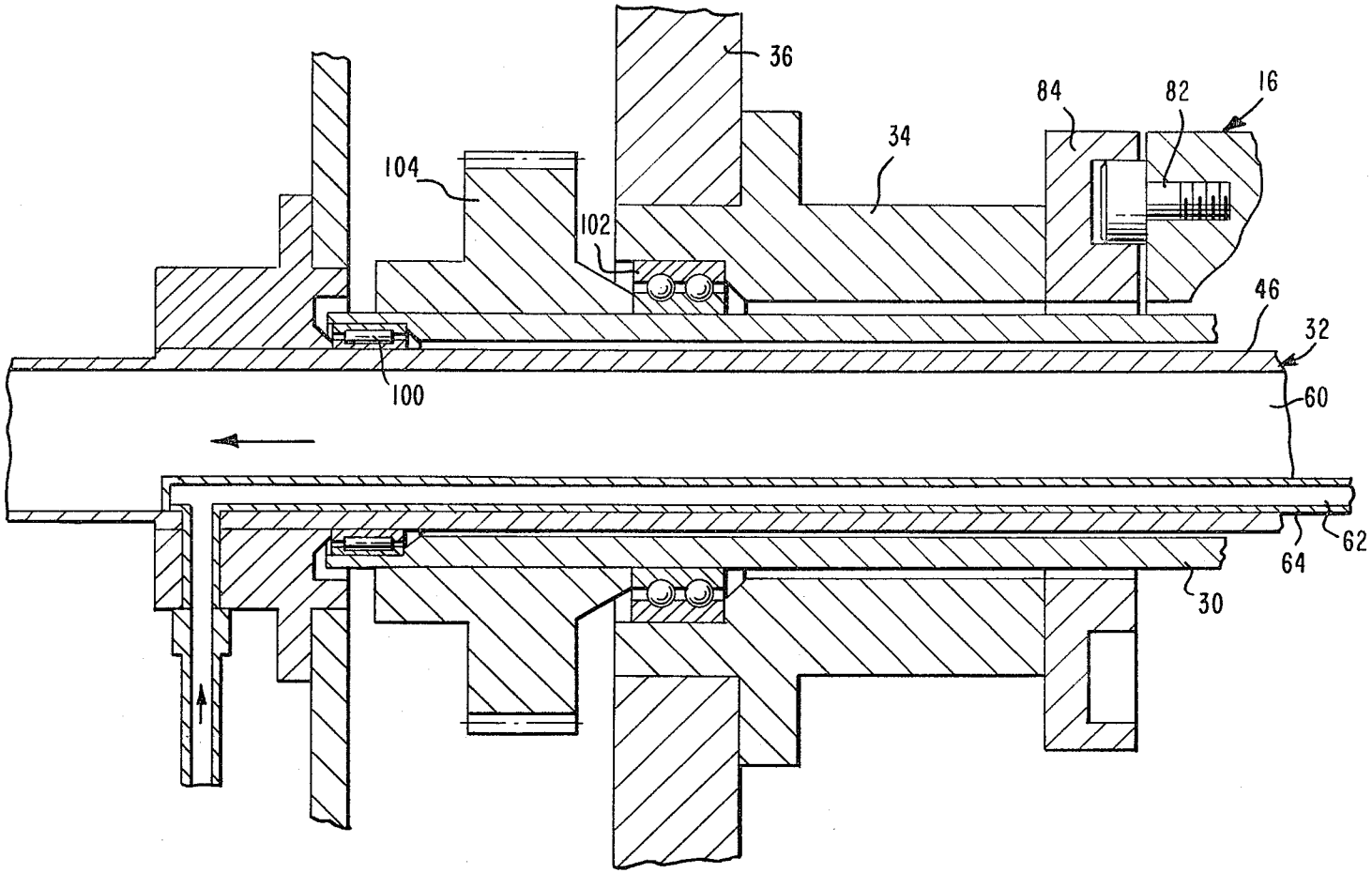
FIG. 4A is a fragmentary, sectional extension of the apparatus shown in FIG. 4.
Figure 5:
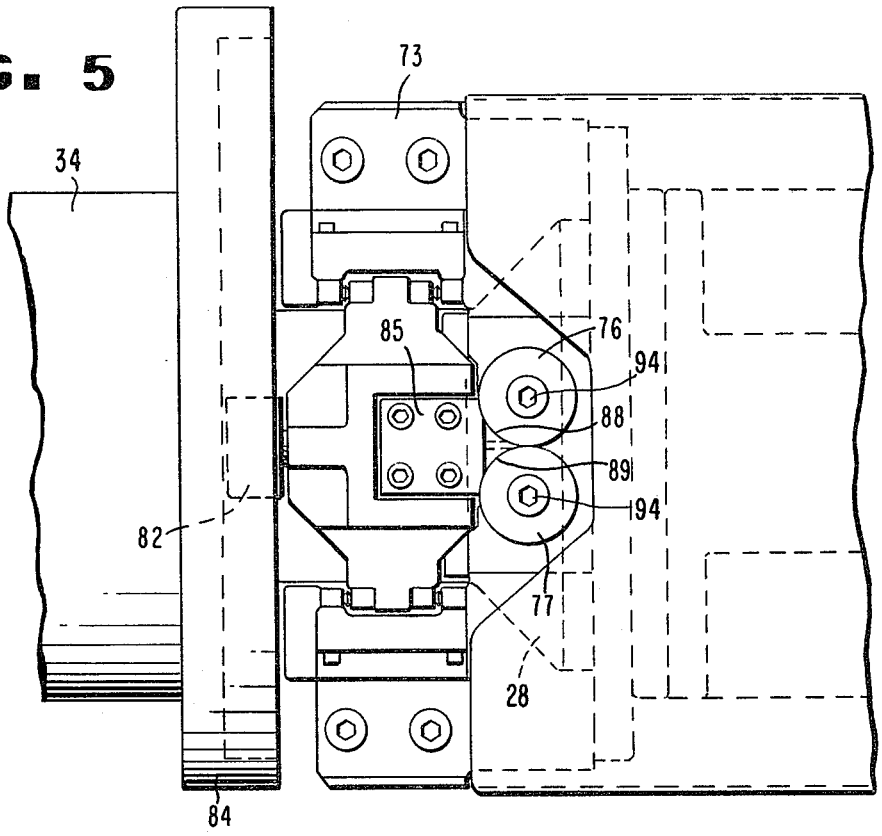
FIG. 5 is an enlarged, fragmentary view of the apparatus shown in FIG. 2.

The manner in which the transport roll 16 is rotatably driven on stator 32 has been shown in FIG. 4A. The shaft 30 at one end of the roll is rotatable on stationary section 46, in bearings 100, 102, and is driven by a gear 104 that is in the gear train for the rolls 10, 12 shown in FIG. 1. As noted above, end piece 28 on shaft 30 rotates on bearing 49. Except for omission of gear 104, the same structural arrangement is provided at the other end of roll 16.

Figure 6:
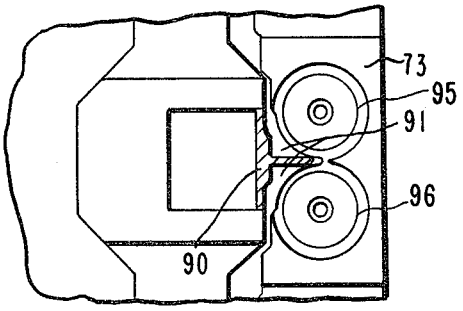
FIG. 6 is a fragmentary view of the corner-rounding assembly shown in FIGS. 2, 4, 5, with the punch and dies removed.
Figure 7:
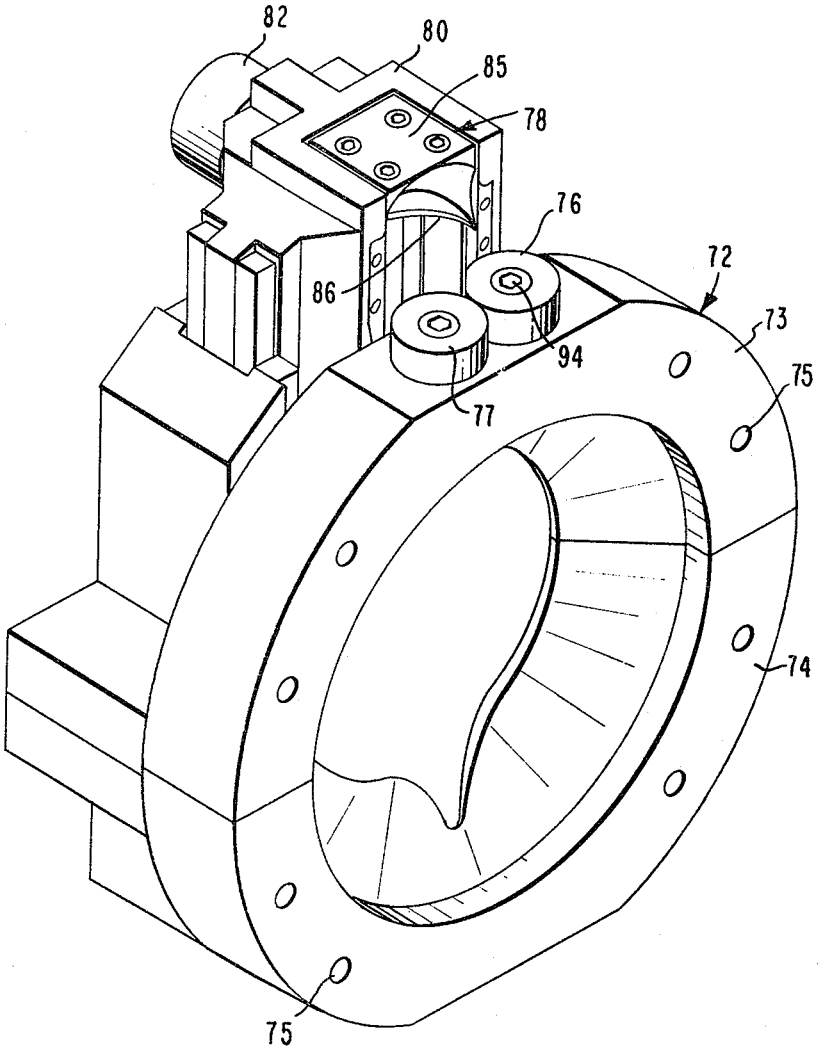
FIG. 7 is an enlarged, perspective view of the corner-rounding assembly.
Figure 8:
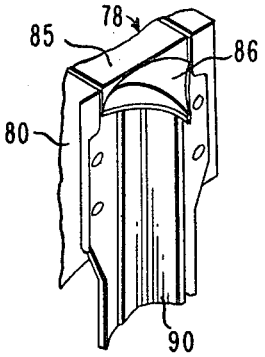
FIG. 8 is a fragmentary, perspective view of the punch shown in FIGS. 2 and 4–7.

Structural details of the punch are shown in FIGS. 5–8. Shuttle 80 has a seat in which a punch-mounting plate 85 is fastened. Projecting from the plate, there is an integral pointed member 86 in the form of a beak. It has arcuate cutting edges shaped to coact with cutting edges 88, 89 on die inserts 76, 77. The upper surface of punch member 86 is smoothly rounded; both the upper surface and the arcuate cutting edges are sloped inwardly toward the axis of roll 16. Fastened to the inner side of shuttle 80, beneath punch member 86, there is a T-shaped member 90 having its leg disposed radially, at the centerline of the punch member. As best shown in FIGS. 4 and 6, there are passageways 91 between T-shaped member 90 and die section 73 and the passageways extend into a space 92 over the slots 52 between fingers 50. A partial flange 94 on shaft 30, beneath punch 78, serves as the inner wall of passageways 91 when shuttle 80 is in the outermost position 80' shown in phantom in FIG. 4.

Figure 9A:
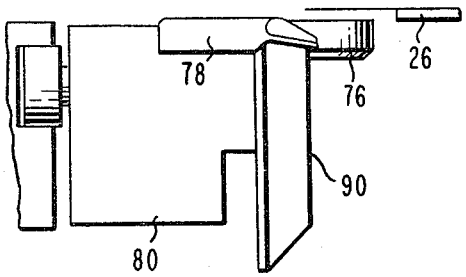
FIGS. 9A, B, C, D show sequential movements of the punch during a corner-rounding operation.
Figure 9B:
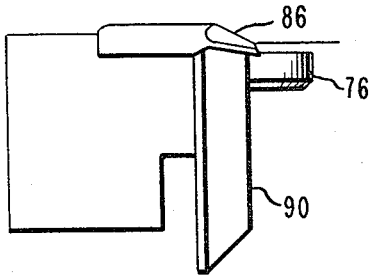
Figure 9C:
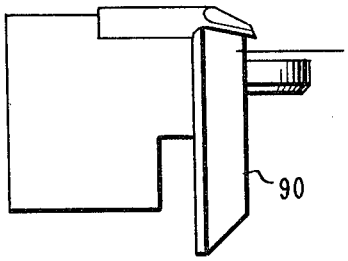
Figure 9D:
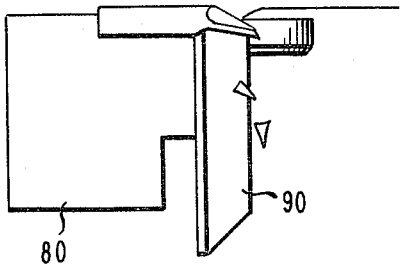

In operation, a continuous web 14 is fed to driven roll 10 and cut into sheets by coacting blades on rolls 10, 12. Both the web and a cut sheet are retained on the surface of roll 10 by vacuum feature V. The cut sheet is transferred directly to roll 16 by the combined action of pressure feature P on roll 10 and the vacuum zone V on roll 16. Rolls 10, 12, 16 are of the same diameter and are driven synchronously so that the edges of successive sheets abut at or very close to the centerlines of two, spaced, radially aligned, corner-rounding assemblies 22. The movement of punches 78 during a corner-rounding operation is shown in FIG. 9. In FIG. 9A, punch 78 is in its normal position below the surface of shell 26. As shuttle 80 is moved outwardly with cam follower 82, the rounded top of punch member 86 pushes the corners at one side of two sheets apart (FIG. 9B) and moves to a position outside the sheets (FIG. 9C). At this time, the edges of the sheets are held apart, in a proper position for corner-rounding, by the leg of T-shaped member 90. They are returned to that position due to their inherent stiffness and the vacuum exerted through shell 26. As shuttle 80 moves inwardly, the point of punch member 86 first enters the space between the sheets. Then, the arcuate cutting edges of the punch member contact the sheet edges and, with the edges 88, 89 on die inserts 76, 77, make a progressive cut across the corners of both sheets. Punch member 86 continues inwardly to its normal position. Simultaneously, corners are cut on the other side of the sheets by the corner-rounding assembly 22 at the other end of roll 16. Chips cut from the corners (FIG. 9D) travel inwardly through passageways 91, spaces 92 and slots 52 to the chamber 60, whence they are carried to a waste collector.

What is claimed as new and desired to be secured by Letters Patent is:

1. In an apparatus having a roll over which a web is advanced continuously as sheets are cut therefrom, the improvement comprising provision of a transport roll located adjacent said cutting roll, said transport roll having a peripheral surface located to receive successive abutting cut sheets, and a pair of spaced, cam-actuated, corner-rounding assemblies associated with said transport roll, there being an assembly at each side of the path of transport, said transport roll being coupled to the cutting roll for rotation in synchronism therewith, each corner-rounding assembly including a die located beneath the level of said surface, a punch and means mounting the punch for reciprocation radially from a normal position in said die outwardly to a position beyond said level and back to the normal position, said die being fixed to said transport roll for rotation therewith, said punch being positioned to spread abutting sheets at their edges during its outward movement, there being a radially disposed bar beneath the punch for positioning the sheets as corners are cut during movement of the punch back to its normal position.

2. An apparatus comprising:

a cutting roll over which a web is advanced as sheets are cut therefrom, a transport roll having a peripheral surface located to receive successive abutting sheets directly from the cutting roll and a pair of spaced, cam-actuated, corner-rounding assemblies on said transport roll, there being an assembly at each side of the path of transport, said assemblies being located to meet the line of cut between successive sheets, each corner-rounding assembly including a die located beneath the level of said surface, a punch and means mounting the punch for reciprocation radially from a normal position in said die outwardly to a position beyond said level and back to the normal position, said die being fixed to said transport roll for rotation therewith.

3. The apparatus of claim 2 wherein is provided a cam adjacent said punch and a cam follower on said mounting means.

4. The apparatus of claim 3 wherein said cam has a track of lesser radial extent than the roll except for a high spot of greater radial extent.

5. The apparatus of claim 4 wherein said punch has opposed, arcuate, cutting edges and wherein said die has cooperable cutting edges.

6. The apparatus of claim 5 wherein said punch has a rounded exterior adapted to spread successive sheets at the line of cut therebetween as the follower approaches said high spot, said punch then being positioned to cut corners from both sheets after the follower passes the high spot.

7. The apparatus of claim 6 wherein is provided a radially disposed bar beneath said punch for holding the sheets apart until the corners are cut.

8. The apparatus of claim 7 wherein the cutting edges on said punch are sloped inwardly toward the axis of said transport roll.

9. The apparatus of claim 8 wherein said transport roll has a perforated shell forming said surface and wherein is provided vacuum means within the shell for holding sheets on said surface as the corners are cut.

* * * * *